US011867193B2

(12) United States Patent
Bucheru

(10) Patent No.: US 11,867,193 B2
(45) Date of Patent: Jan. 9, 2024

(54) SYSTEMS AND METHODS FOR A ROTARY FAN

(71) Applicant: Bogdan Tudor Bucheru, Lakeway, TX (US)

(72) Inventor: Bogdan Tudor Bucheru, Lakeway, TX (US)

( * ) Notice: Subject to any disclaimer, the term of this patent is extended or adjusted under 35 U.S.C. 154(b) by 0 days.

(21) Appl. No.: 18/109,950

(22) Filed: Feb. 15, 2023

(65) Prior Publication Data

US 2023/0193919 A1 Jun. 22, 2023

Related U.S. Application Data

(63) Continuation of application No. 17/897,544, filed on Aug. 29, 2022, now Pat. No. 11,614,093.

(60) Provisional application No. 63/239,144, filed on Aug. 31, 2021.

(51) Int. Cl.
*F04D 29/26* (2006.01)
*F04D 17/16* (2006.01)

(52) U.S. Cl.
CPC ..... *F04D 29/263* (2013.01); *F04D 17/16* (2013.01)

(58) Field of Classification Search
CPC ..... F04D 29/263; F04D 29/247
See application file for complete search history.

(56) References Cited

U.S. PATENT DOCUMENTS

2017/0082091 A1* 3/2017 Särner ..... F03D 3/02

FOREIGN PATENT DOCUMENTS

EP 2610483 A1 * 7/2013 ..... F03D 3/068
GB 2454525 A * 5/2009 ..... F03D 3/02

* cited by examiner

*Primary Examiner* — Sabbir Hasan
(74) *Attorney, Agent, or Firm* — Pierson IP, PLLC

(57) ABSTRACT

A rotary fan system with dual rotation axes, wherein a driving arm rotates about a first axis, and trailing arm rotates about a second axis.

20 Claims, 21 Drawing Sheets

1200

SYSTEMS AND METHODS FOR A ROTARY FAN

BACKGROUND INFORMATION

Field of the Disclosure

Examples of the present disclosure are related to systems and methods for a rotary fan system with dual rotation axes, wherein a driving arm rotates about a first axis, and trailing arm rotates about a second axis. More particularly, embodiments a driving arm and a trailing arm may be coupled to different ends of a blade, wherein the trailing arm is not rotationally locked with any other element allowing for the attack angle of the blade to change.

Background

A centrifugal fan is a mechanical device for moving air or other gases in a direction at an angle to the incoming fluid. Centrifugal fans often include a ducted housing to direct outgoing air in a specific direction. Generally, the blades in the centrifugal fans rotate about a fixed axis, and have a fixed rotational arc that does not change. This creates a fixed attack angle as the blades rotate about the fixed central axis.

However, there are points while rotating the blades where it may be desirable to change the attack angle of the rotating blades. For example, it may be more desirable to have a larger attack angle corresponding to an outtake of the centrifugal fan to move more air out of the system, while minimizing drag at other points.

Accordingly, needs exist for more effective and efficient systems and methods associated with centrifugal fans that include a driving arm and a trailing arm coupled to different ends of a blade, wherein the trailing arm is not rotationally locked with any other element allowing for the attack angle of the blade to change based on the blade location.

SUMMARY

Embodiments described herein disclose a rotary fan system with dual rotation axes, wherein a driving arm rotates about a first axis, and trailing arm rotates about a second axis. Embodiments may include a blade, driving axle, trailing axle, driving arm, and trailing arm.

The blade may be a fan blade with a linear top and bottom surface, forward curved, or rearward curve. The blade may be configured to drive fluid, gas, etc. responsive to the driving axle rotating the driving arm. The blade may be configured to drive the fluid at different angles, velocities, and amounts based on an attack angle of the blade. The attack angle of the blade may change based on a position of the blade along a first and second circumference. A first end of the blade may be coupled to the driving arm, and a second end of the blade may be coupled to the trailing arm. In embodiments, a length of the blade may be greater than a distance from a center of the first circumference to the second circumference.

The driving axle may be a shaft, rod, etc. that is configured to rotate and transfer energy and torque to the blade. The driving axle may be configured to rotate a driving arm, to allow the first end of the blade to travel along the first circumference. In embodiments, a proximal end of the driving arm may be coupled to the driving axle, and may be rotational locked with the driving axle. To this end, responsive to the driving axle rotating, the driving arm may correspondingly rotate.

The trailing axle may be a shaft, rod, etc. that is configured to be a fixed axle that allows trailing arm to freely rotate about it. The trailing axle may be configured to provide structural support to a proximal end of trailing arm, to allow the second end of the blade to travel along the second circumference. In embodiments, a proximal end of the trailing arm may be coupled to the trailing axle. In embodiments, the trailing axle may not provide any rotational energy or torque to trailing arm. In embodiments, a distance between the trailing axle and the driving axle may be less than the length of the blade. In embodiments, the trailing axle may be aligned or misaligned with the driving axle in a longitudinal and/or lateral plane.

Driving arm may be an arm that is configured to rotate about the first circumference responsive to receiving torque from the driving axle. The driving arm may have a proximal end coupled to the driving axle, and a distal end coupled to a first end of the blade. Responsive to the driving axle rotating, the driving arm may correspondingly rotate to move the blade.

Trailing arm may be an arm that is configured to rotate about the second circumference responsive to the driving arm moving the blade. The trailing arm may have a proximal end coupled to the trailing axle, and a distal end coupled to a second end of the blade. Responsive to the blade moving, the blade may pull the distal end of the trailing arm around the second circumference. The trailing arm may be configured to independently rotate based on the forces applied to the trailing arm from the blade, which may allow an attack angle of the blade to continuously change. This may also change the direction that the blade pushes the fluid. In embodiments, the angular movement of the driving arm may be a fixed speed, whereas the angular movement of the trailing arm may be a variable speed based on the positioning of the blade. Accordingly, the speed of the angular movement of the trailing arm may be directly correlated to a current attack angle of the blade and the fixed speed of the driving arm. To this end, systems that utilize a plurality of blades each coupled to a different driving arm and trailing arm will have each driving arm rotating at the same speed, wherein the angular movement of each of the trailing arms will be independent, and different, from each other.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
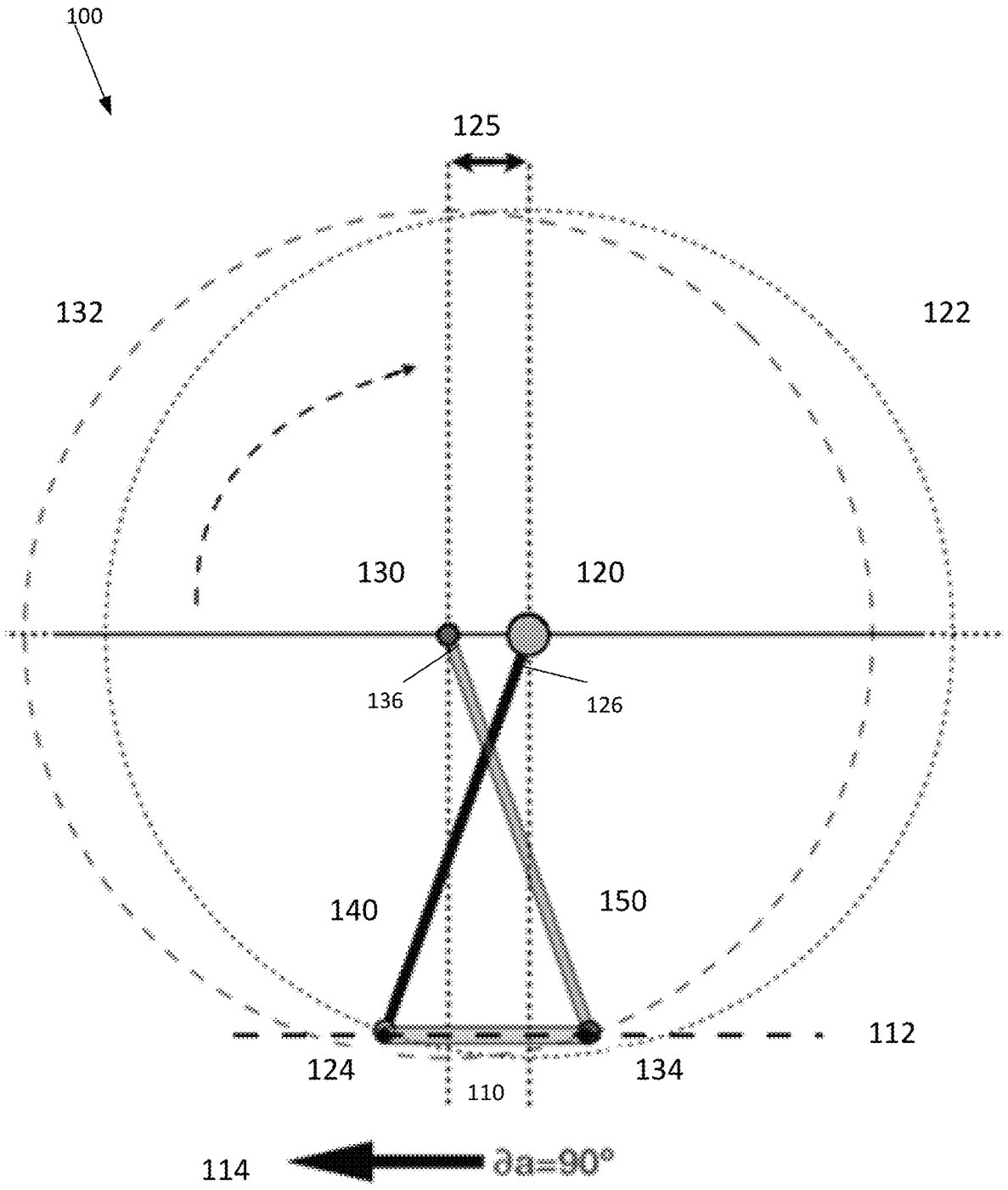
FIG. 1 depicts a fan system, according to an embodiment.
Figure 2:
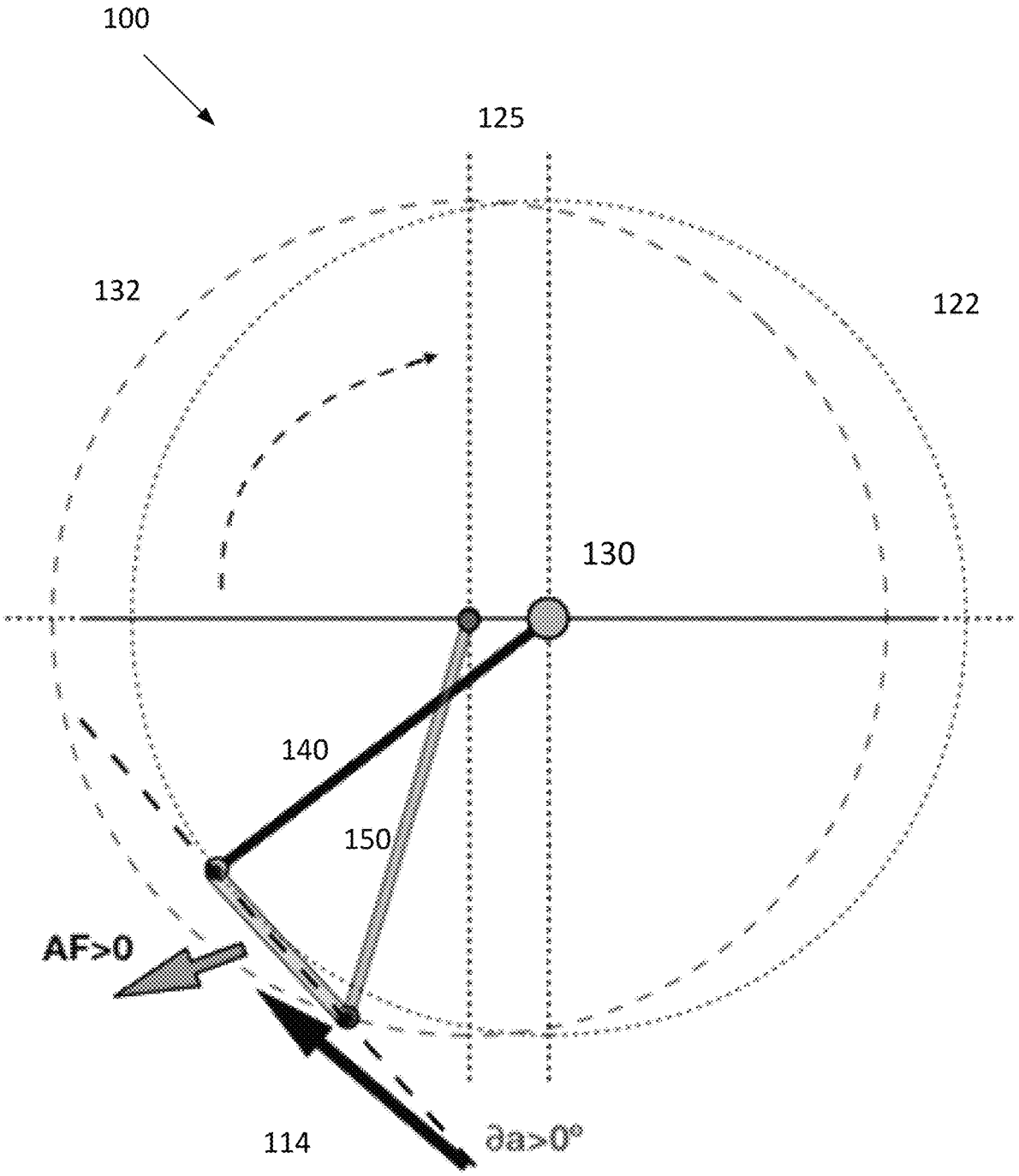
FIGS. 2-5 depicts a fan system, according to an embodiment.
Figure 3:
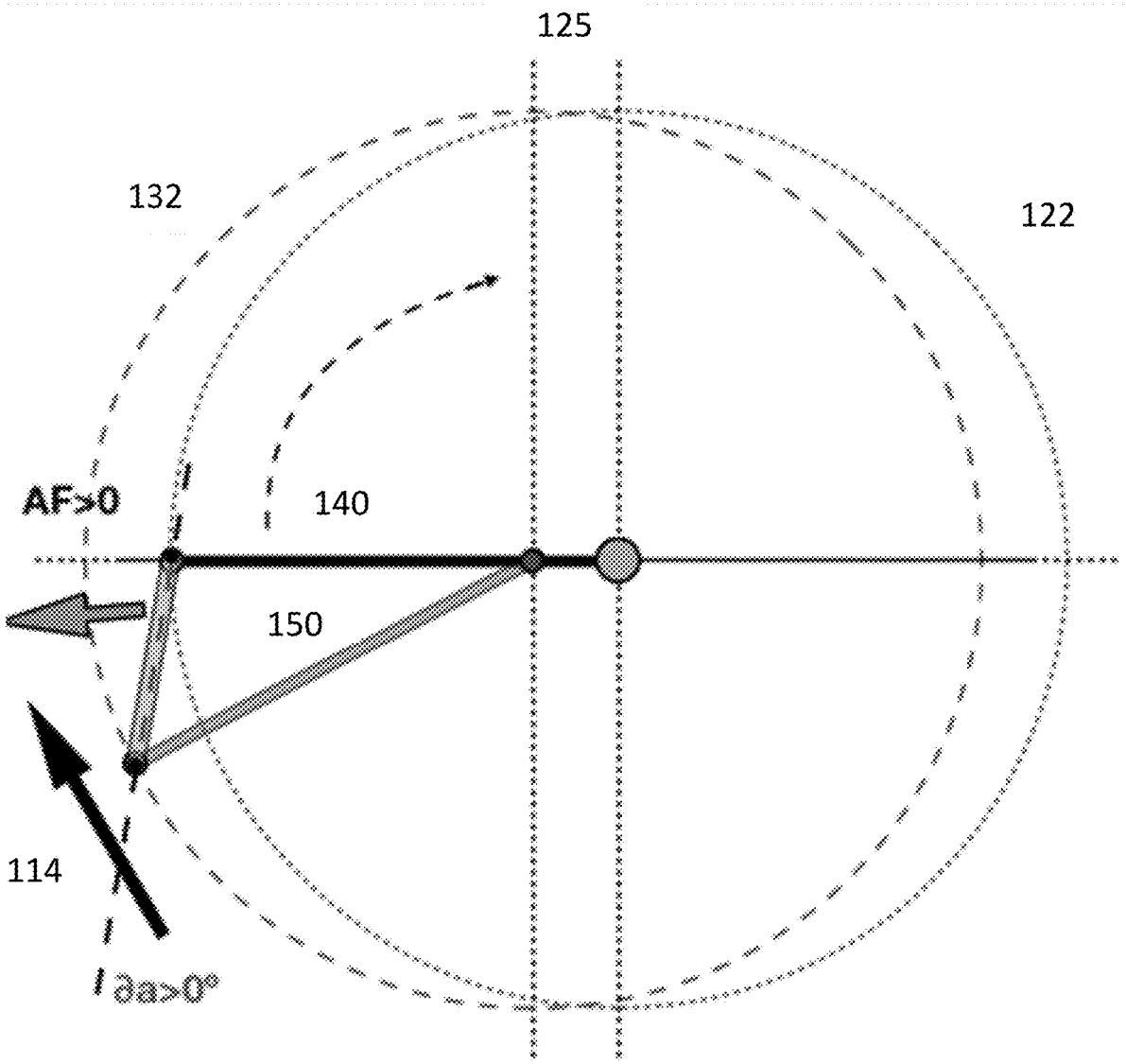
Figure 4:
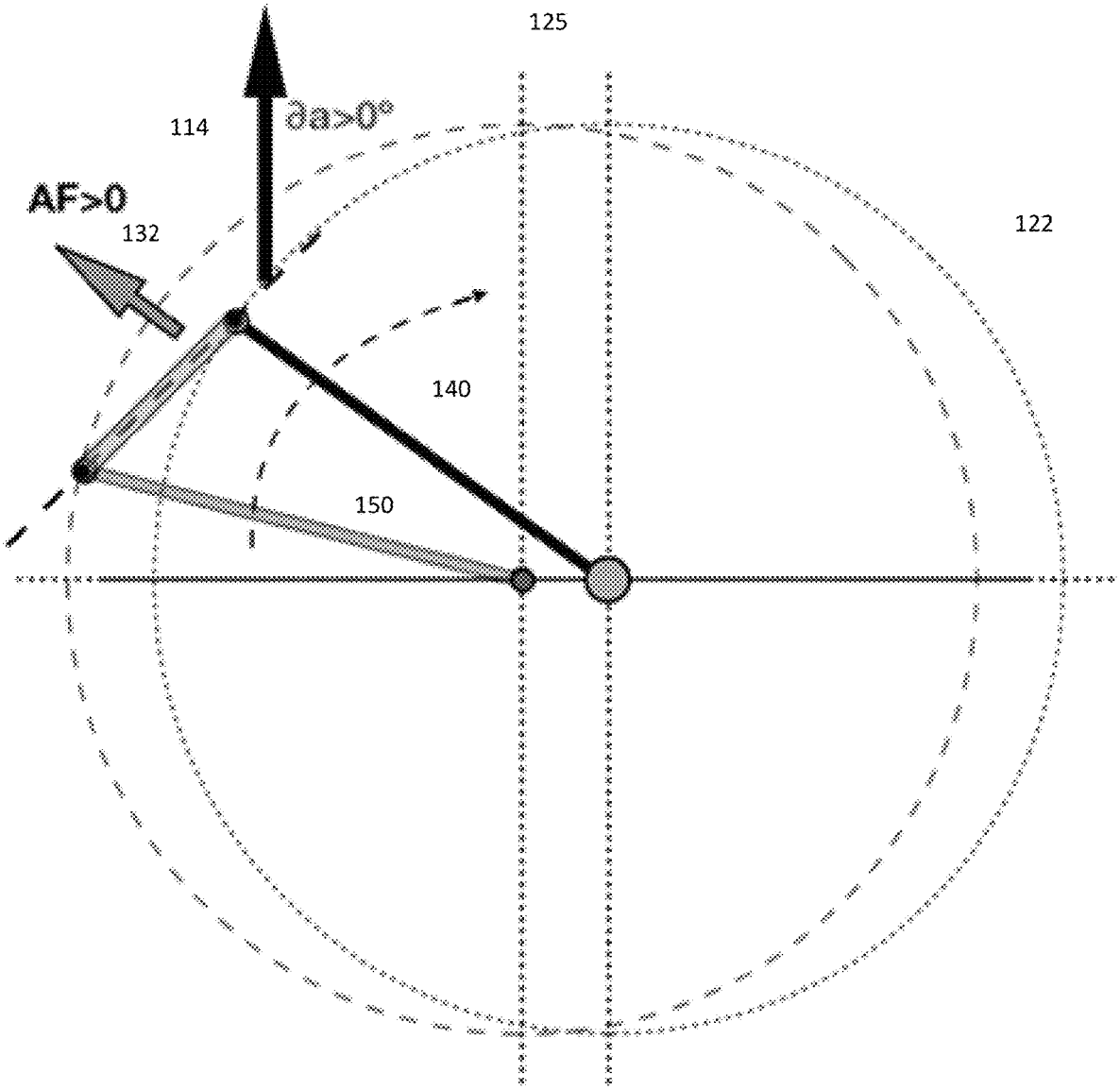
Figure 5:
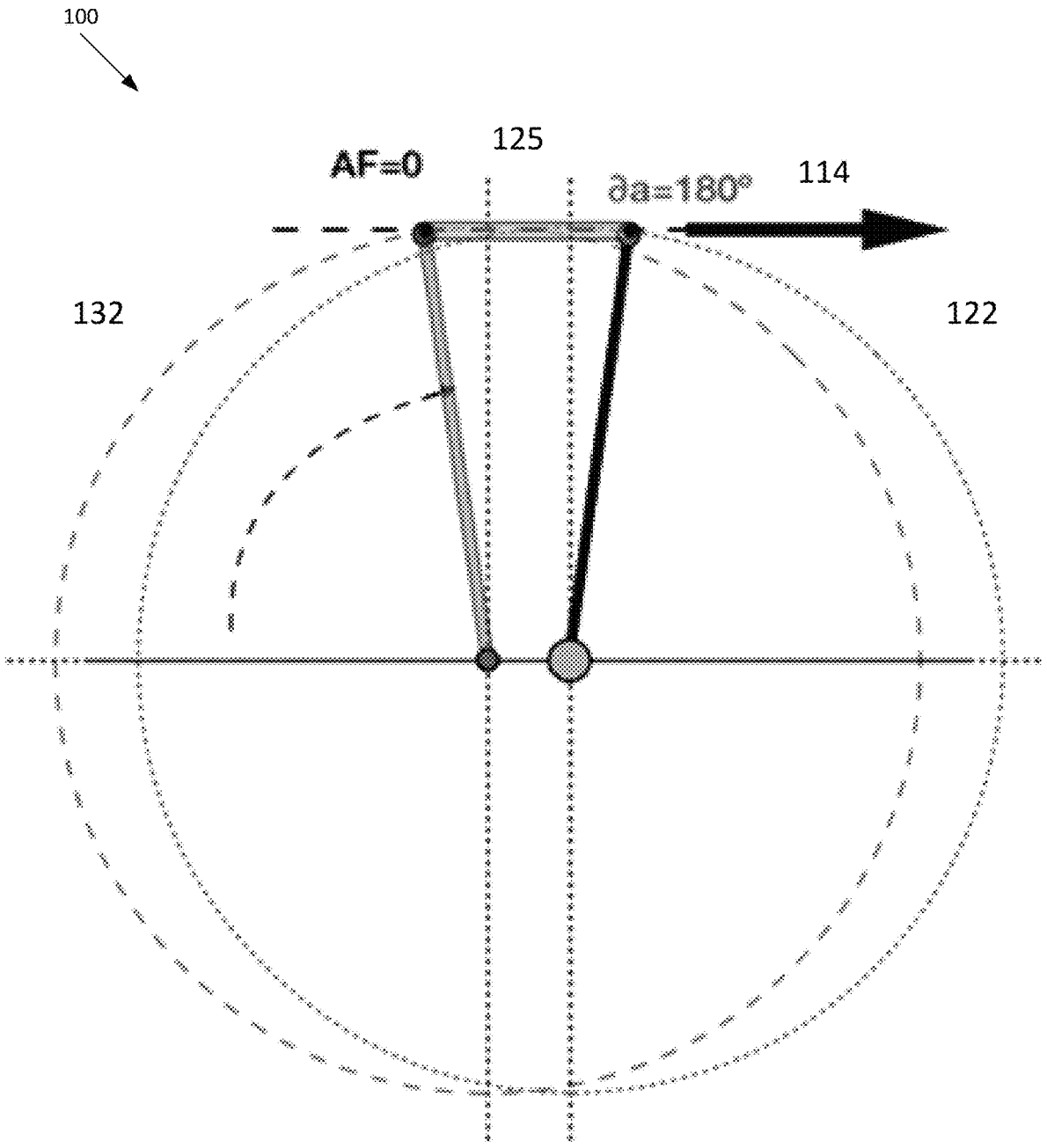

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

FIG. 1 depicts a fan system 100, according to an embodiment. Fan system 100 may include a blade 110, driving axle 120, trailing axle 130, driving arm 126, and trailing arm 136.

Blade 110 may be a fan blade with a linear top and bottom surface, forward curved, or rearward curve. Blade 110 may be configured to drive fluid, gas, etc. responsive to the driving axle 120 rotating the driving arm 126. Blade 110 may be configured to drive the fluid at different angles, velocities, and amounts based on an attack angle 114 of blade 110. The attack angle 114 may change based on a position of the blade 110 along a first circumference 122 and second circumference 132, wherein first circumference has a center at driving axle 120 and second circumference 132 has a center at trailing axle 130. A first end (driving end) of the blade 110 may be coupled to distal end 124 of driving arm 120, and a second end (trailing end) of the blade 110 may be coupled to a distal end 134 of the trailing arm 130. In embodiments, because the first end and the second end of blade 110 move at different speeds and along different circumferences, the attack angle 114 of blade 110 may dynamically change as the blade travels around the different axis. In embodiments, a length of the blade may be greater than a distance 125 from a center of the first circumference 122 to the second circumference 132.

The driving axle 120 may be a shaft, rod, etc. that is configured to rotate and transfer energy and torque to the blade 110 via driving arm 140. Driving axle 120 may be configured to rotate driving arm 140, to allow the first end of the blade 110 to travel along the first circumference 122. In embodiments, a proximal end 126 of the driving arm 140 may be coupled to the driving axle 120, and may be rotational locked with the driving axle 120. To this end, responsive to the driving axle 120 rotating, the driving arm 140 may correspondingly rotate. This may control the rotational direction of blade 110.

The trailing axle 130 may be a shaft, rod, etc. that is configured to be a fixed axle that allows trailing arm 150 to freely rotate about it. Trailing axle 130 may be configured to provide structural support to a proximal end 136 of trailing arm 150, to allow the second end of the blade 110 to travel along the second circumference 132. In embodiments, the trailing axle 130 may not provide any rotational energy or torque to trailing arm 150. In embodiments, a distance 125 between the trailing axle 130 and the driving axle 120 may be less than the length of the blade 110. In embodiments, the trailing axle 130 may be aligned or misaligned with the driving axle 120 in a longitudinal and/or lateral plane.

Driving arm 140 may be an arm that is configured to rotate about the first axis responsive and receiving torque from the driving axle 120. Driving arm 140 may have a proximal end 126 coupled to the driving axle 120, and a distal end 124 coupled to a first end of the blade 110. Responsive to the driving axle 120 rotating, the driving arm 140 may correspondingly rotate to move the blade 110.

Trailing arm 150 may be an arm that is configured to rotate about the second axis responsive to the driving arm 120 moving the blade 110. Trailing arm 150 may have a proximal end 136 coupled to the trailing axle 130, and a distal end 134 coupled to a second end of the blade 110. Responsive to the blade 110 moving, the blade 110 may pull the distal end 134 of the trailing arm 130 around the second circumference 132. Trailing arm 150 may be configured to independently rotate based on the forces applied to trailing arm 150 from the blade 110, which may allow an attack angle 114, and speed, of the blade 110 to continuously change.

This may also change the angle 112 of blade 110 and the direction that the blade 110 pushes the fluid. In embodiments, the angular movement of the driving arm 140 may be a fixed speed, whereas the angular movement of the trailing arm 150 may be a variable speed based on the positioning and angle of the blade 110. Accordingly, the speed of the angular movement of the trailing arm 150 may be directly correlated to a current attack angle 114 of the blade and the fixed speed of the driving arm.

To this end, systems that utilize a plurality of blades each coupled to a different driving arm and trailing arm will have each driving arm 140 rotating at the same speed, wherein the angular movement of each of the trailing arms 150 will be independent, and different, from each other.

FIGS. 2-5 depicts system 100, according to an embodiment. Elements depicted in FIGS. 2-5 may be described above, and for the sake of brevity a further description of these elements may be omitted.

As depicted in FIGS. 2-5, as driving axle 130 rotates driving arm 140, driving arm 140 may pull a first end of blade 110 along the first circumference 122. After a delay based on the pulling of the first end of blade 110, blade 110 may pull the distal end of trailing arm 150 along the second axis.

This may change the blade 110 position and angle, which changes the air flow of caused by blade 110. Specifically, in FIG. 2, the attack angle 114 of blade may be greater than zero, which causes the air flow caused by blade 110 to be greater than zero in a vector away from first circumference 122 towards the second circumference 132. Whereas, in FIG. 5, the attack angle 114 of blade 110 may be one hundred eighty degrees, and extend in a plane in tangential to both the first circumference 122 and the second circumference 132, causing the air flow caused by blade 110 to be zero, or minimal.

Figure 6:
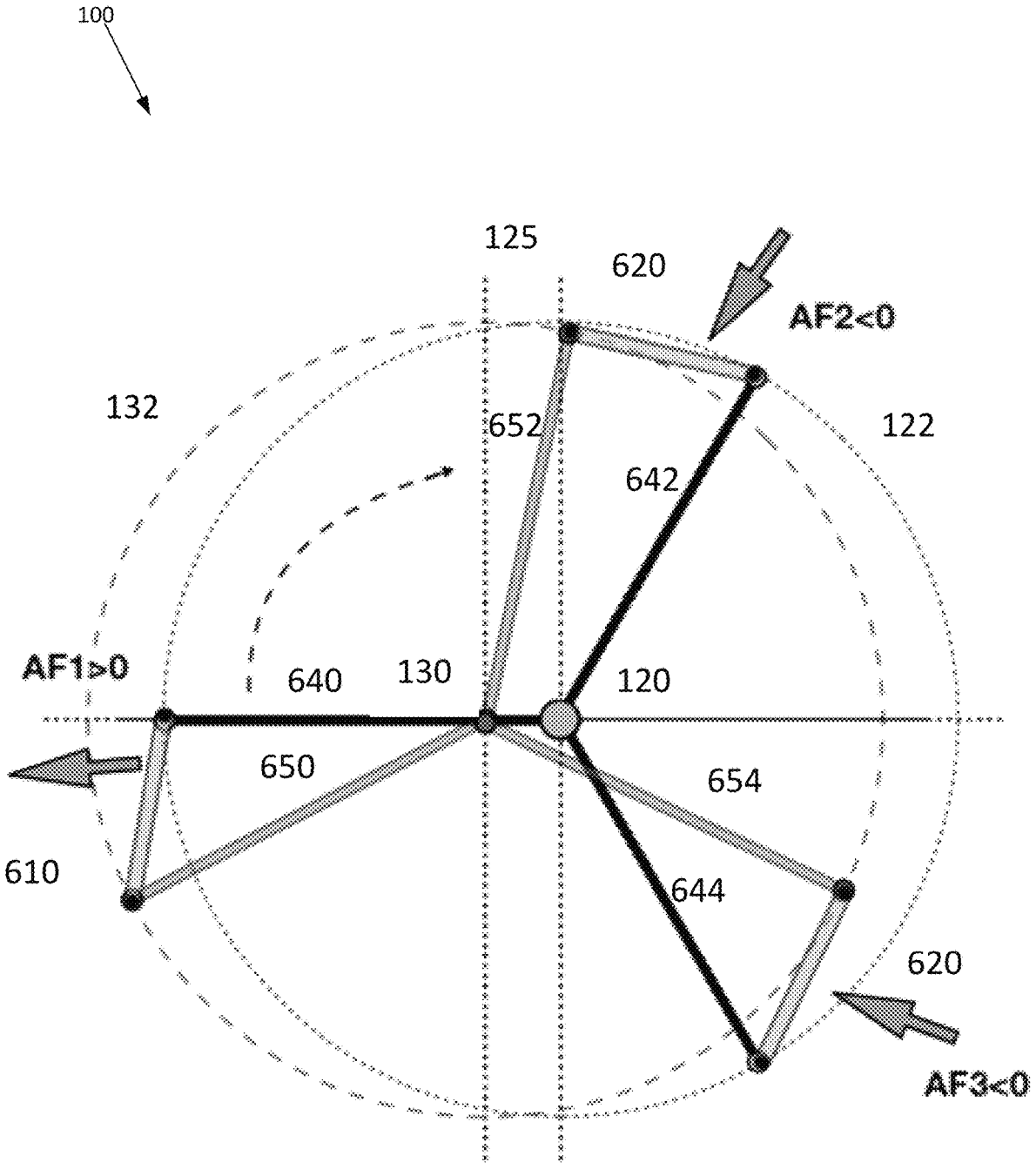
FIG. 6 depicts a fan system that includes a plurality of blades, according to an embodiment.

FIG. 6 depicts a system 600 that includes a plurality of blades 610, 620, 630, according to an embodiment. Elements depicted in FIG. 6 may be described above, and for the sake of brevity a further description of these elements may be omitted.

The three blades 610, 620, 630 may have symmetrically spaced, such than angle between adjacent blades is equal. One skilled in the art may appreciate that system 600 may include any number of blades. Each of the blades 610, 620, 630 may have a different attack angle, causing different air flow vectors at a given time. The attack angles of each of the blades 610, 620, 630 may continuously change independently from the other blades.

Each of the blades 610, 620, 630 may have a first end coupled to an attack arm 640, 642, 644, respectively. Each of the blades 610, 620, 630 may have a second end coupled to a trailing arm 650, 652, 654, respectively. Each of the attack arms 640, 642, 644 may rotate based on a rotation of driving axle 120, such that each of the attack arms 640 rotates at a continuous fixed speed. Yet, each of the trailing arms 650, 652, 654 may rotate at different speed around trailing axle 130, which is independent from the other trailing arms 650. This may be due to a corresponding blade applying forces against the trailing arms 650, 652, 654. However, because the air flow caused by each of the blades 610, 620, 630 and attack angle of each of the blades 610, 620, 630 they may be rotating at different speeds at different points along the second circumference 132. This may cause a lag in the rotation of the corresponding trailing arms 650, 652, 654.

Figure 7:
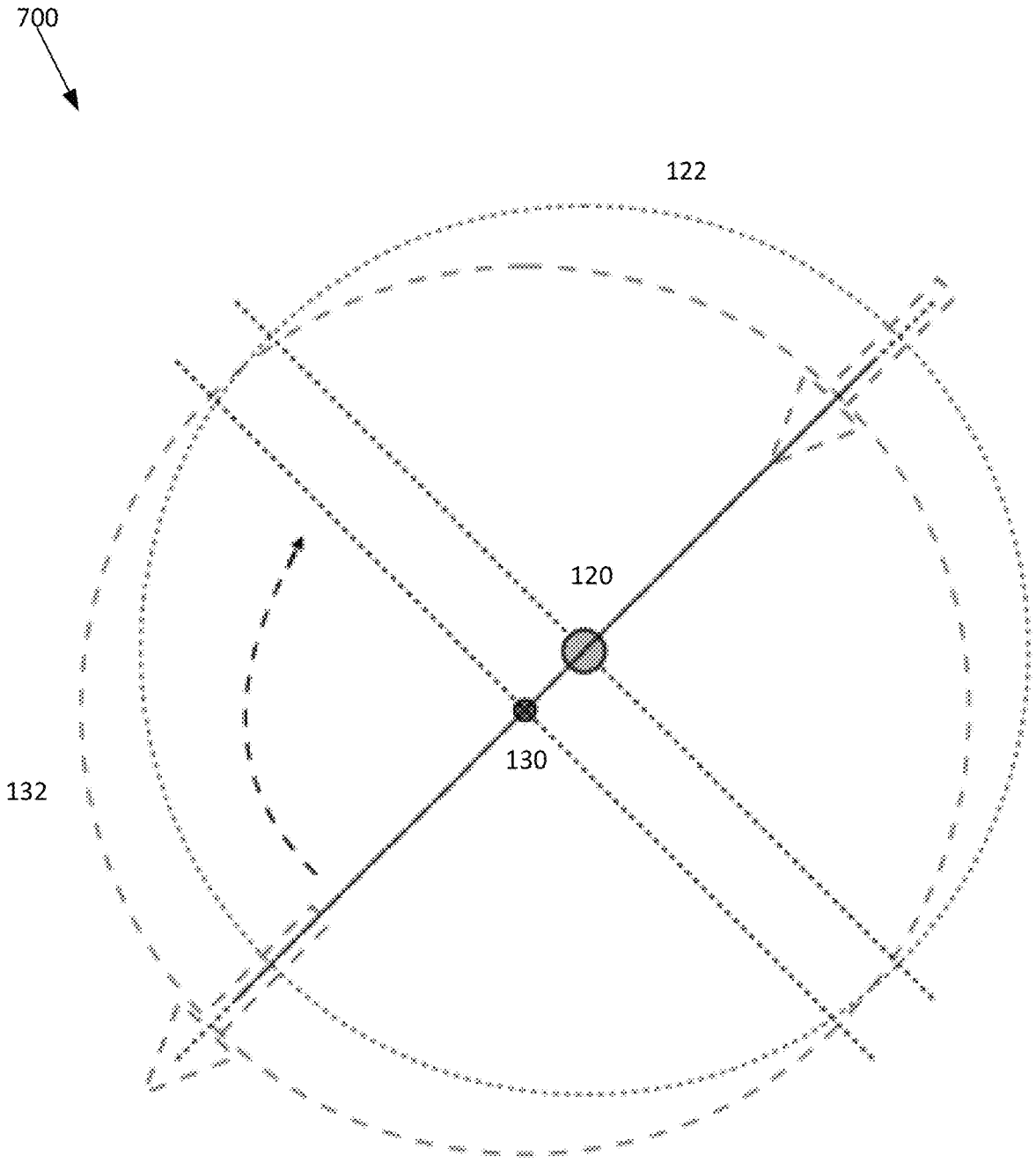
FIG. 7 depicts a fan system that includes a driving axle and a trailing axle, according to an embodiment.

FIG. 7 depicts a system 700 that includes a driving axle 120 and a trailing axle 130, according to an embodiment.

As depicted in FIG. 7, the driving axle 120 and the trailing axle 130 may be misaligned in both a lateral and longitudinal direction. This may enable their corresponding circumferences 122, 132, with equal diameters, to be offset from each other in different ways. By changing the locations of overlaps and off settings, the air flow patterns caused by the rotating blades may change as well.

Figure 8:
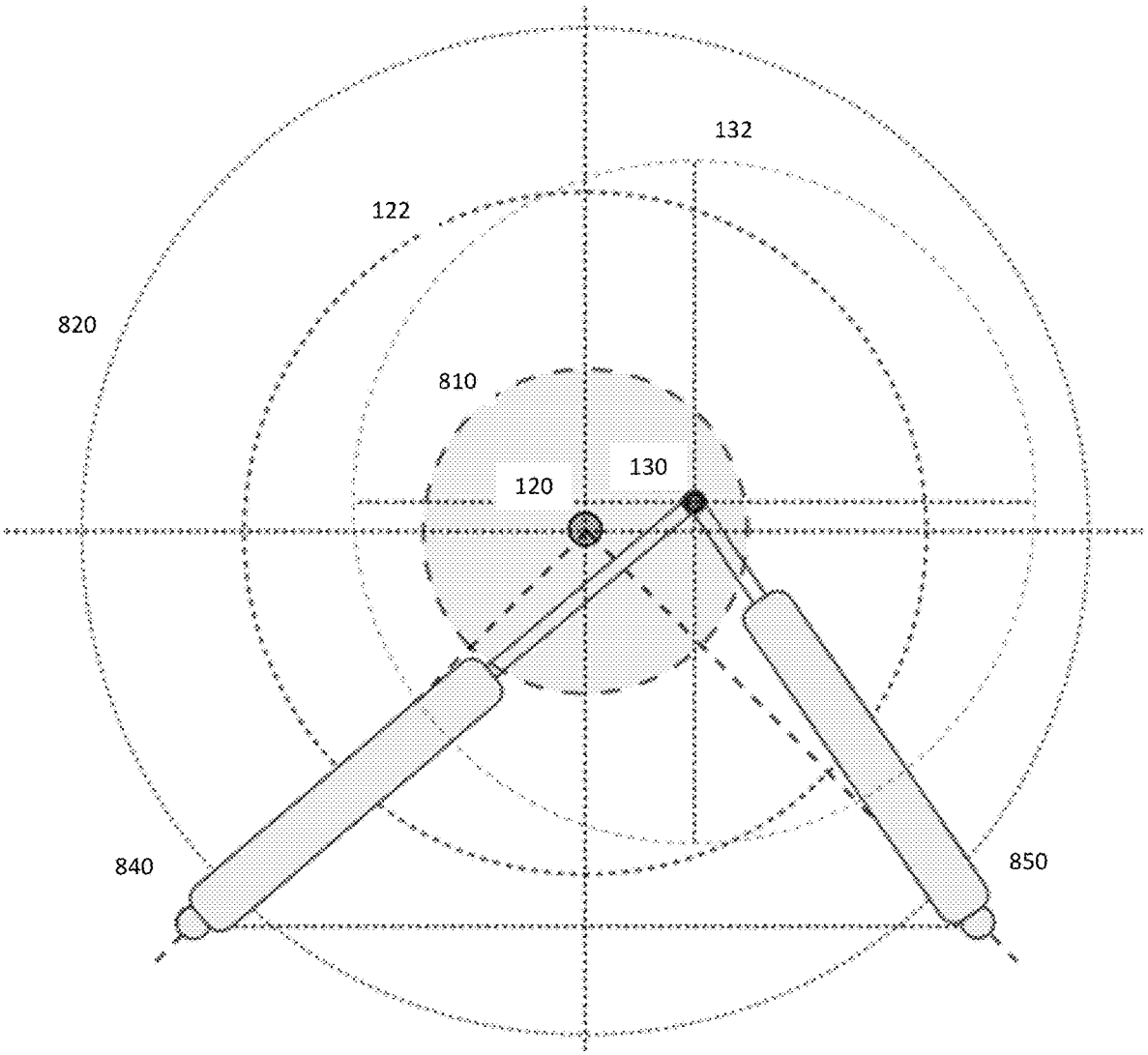
FIGS. 8 and 9 depict a fan system that utilizes hydraulic arms to change a location of a trailing axle, according to an embodiment.
Figure 9:
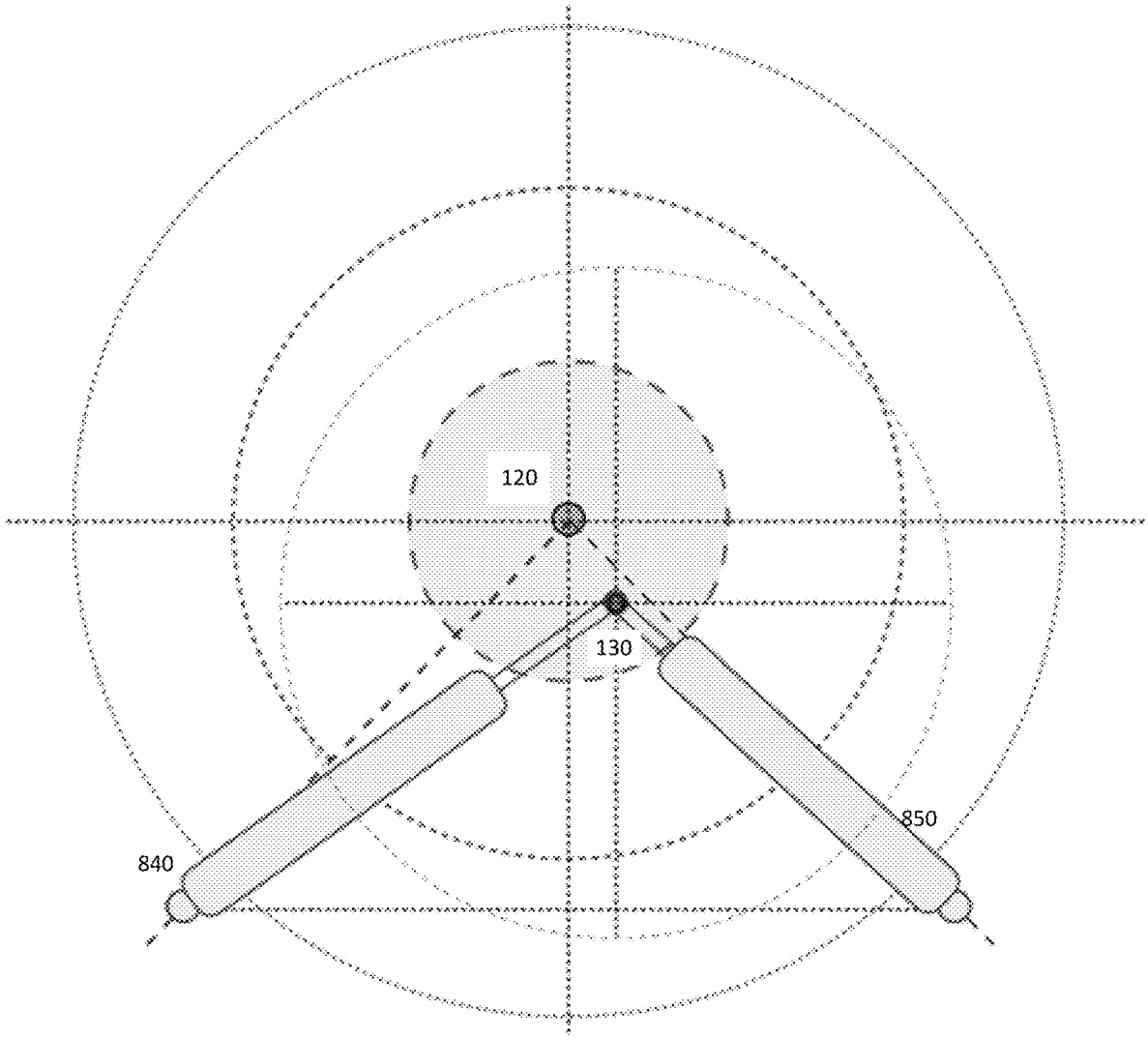

FIGS. 8 and 9 depict a system 800 that utilizes hydraulic arms 840, 850 to change a location of trailing axle 130, according to an embodiment.

A first hydraulic arm 840 may be configured to control a positioning of trailing axle 130 along a longitudinal axis by extending and retracting its arm. A second hydraulic arm 850 may be configured to control a positioning of trailing axle 130 along a lateral axis by extending and retracting its arm. By simultaneously moving the arms of first hydraulic arm 840 and second hydraulic arm 850, trailing axle 130 may be positioned within a movement circumference 810, wherein circumference 810 may have a radius that is less than or equal to the blade length. This may enable trailing axle 130 to rotate around a fixed driving axle 120.

By moving trailing axle 130 while driving axle 120 is rotating the blades, the attack angles of the blades may move while in use, due the relative positioning of first circumference 122 and second circumference 132, wherein first circumference 122 and second circumference 132 may have a same diameter. Specifically, second circumference 132 may move within a fourth circumference 820, wherein the fourth circumference has a diameter that is equal to the diameter of the second circumference 132 plus two times the diameter of the movement circumference 810.

Figure 10:
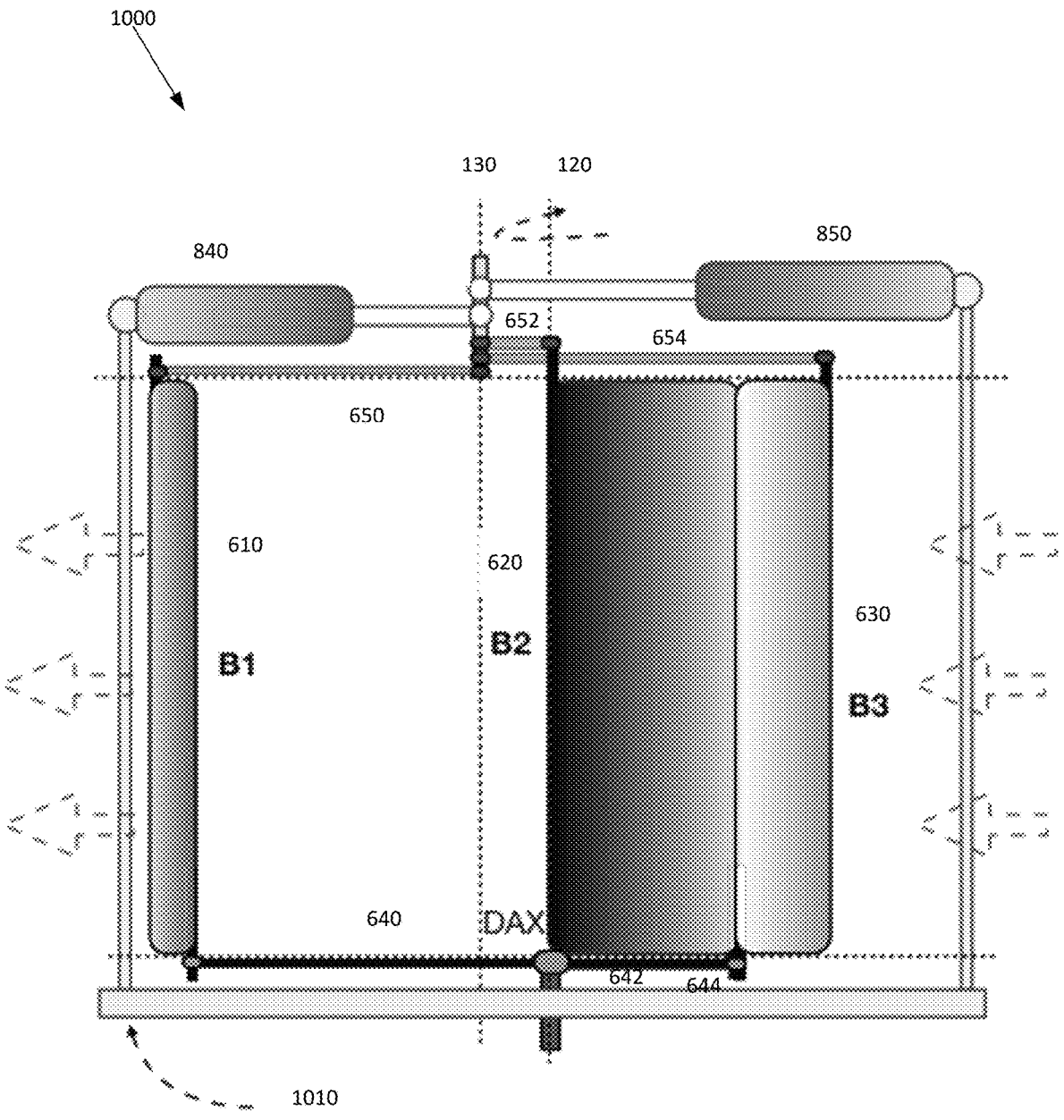
FIG. 10 depicts an embodiment of a fan system utilizing hydraulic arms within a frame, according to an embodiment.

FIG. 10 depicts an embodiment of system 1000 utilizing hydraulic arms 840, 850 within a frame 1010, according to an embodiment. Elements depicted in FIG. 10 may be described above, and for the sake of brevity a further description of these elements may be omitted.

As depicted in FIG. 10, hydraulic arms 840, 850 may be configured to move the trailing axle 130. Further, a plurality of trailing arms 650, 652, 654 may have their proximal ends coupled to trailing axle 130. The distal ends of the trailing arms 650, 652, 654 may be coupled to a second end of blades 610, 620, 630, respectively. A plurality of driving arms 640, 642, 644 may have their proximal ends coupled to driving axle 120. The distal ends of the driving arms 640, 652, 654 may be coupled to a first end of blades 610, 620, 630, respectively.

As driving axle 120 concurrently rotates each of the driving arms 640, 642, 644 the blades 610, 620, 640 may also rotate. This may be followed by the movement of each of the trailing arms 650, 652, 654.

As can be seen in FIG. 10, each of the blades 610, 620, 630 may have a different angle at a different point in time, which may cause each of them to have a different attack angle.

Figure 11:
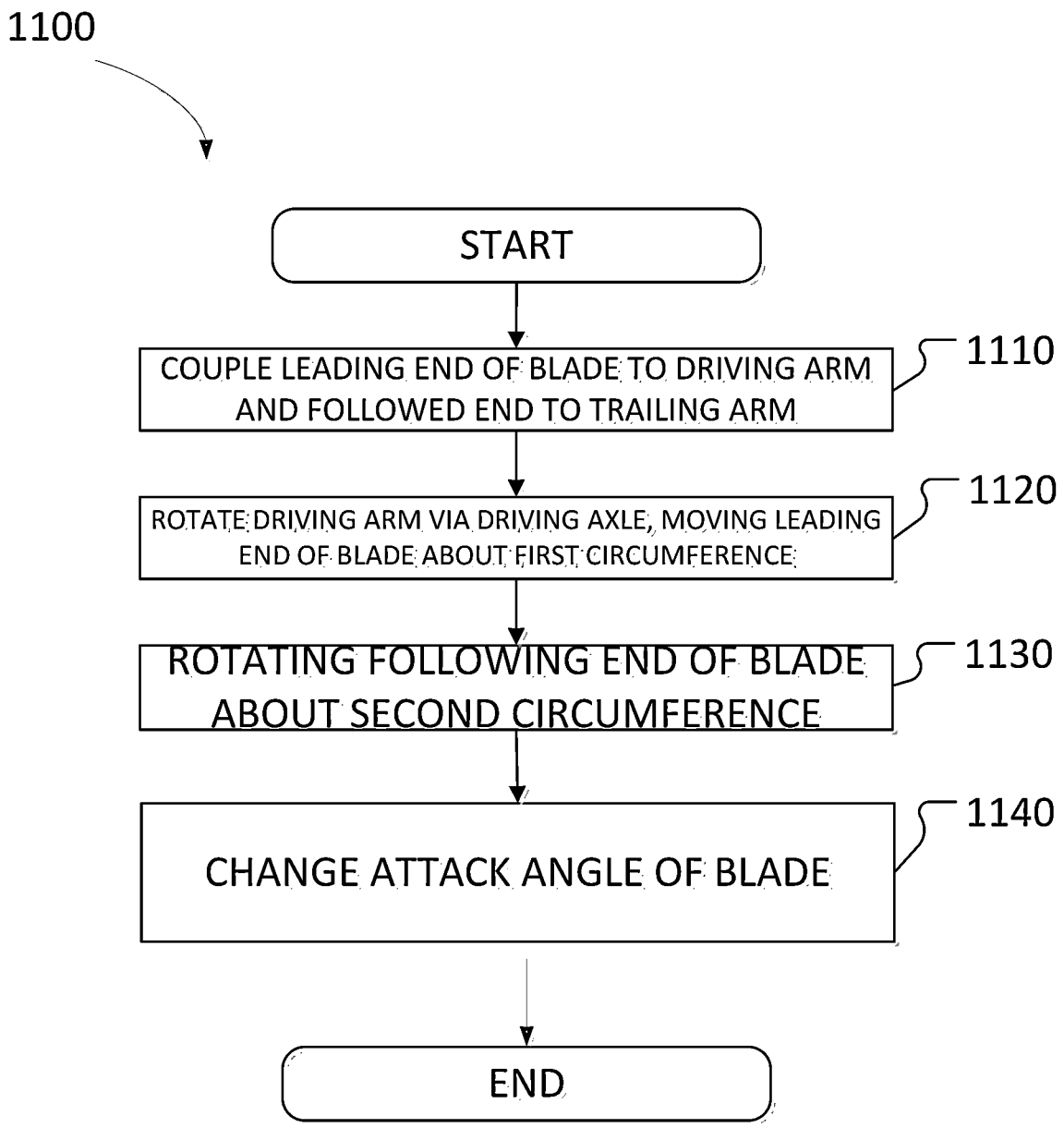
FIG. 11 illustrates a method for a fan system, according to an embodiment.

FIG. 11 illustrates a method 1100 for a fan system 1100, according to an embodiment. The operations of method 1100 presented below are intended to be illustrative. In some embodiments, method 1100 may be accomplished with one or more additional operations not described, and/or without one or more of the operations discussed. Additionally, the order in which the operations of method 1100 are illustrated in FIG. 11 and described below is not intended to be limiting.

At operation 1110, a leading end of a blade may be coupled with a driving arm that rotates about a driving axle, and a trailing end of a blade may be coupled with a trailing axle, wherein the driving axle and the trailing axle are offset from each other.

At operation 1120, the driving axle may rotate, pulling the leading end of the blade along a first circumference.

At operation 1330, the blade may transfer forces to the trailing arm, pulling the trailing end of the blade along a second circumference. In embodiments, the trailing arm may be configured to rotate at a different speed than the driving blade.

At operation 1440, due to the trailing arm and driving arm moving at different rotational speeds at various points and times, and traveling along different circumferences, an attack angle of the blade may change as the blade moves.

Figure 12A:
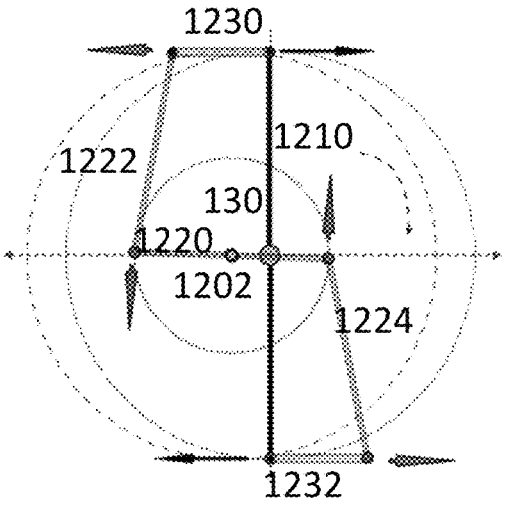
FIGS. 12A and 12B depict a fan system, according to an embodiment.
Figure 12B:
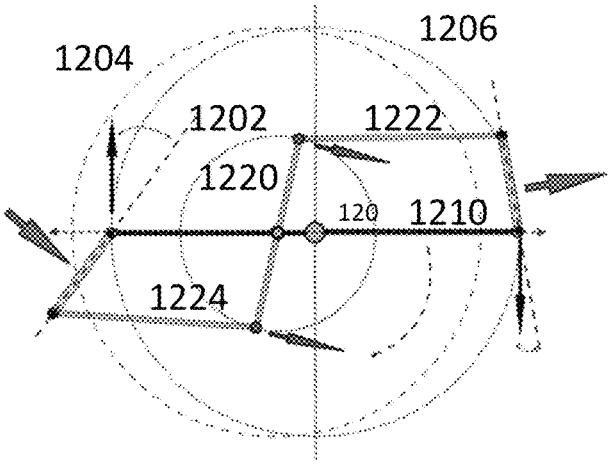

FIGS. 12A and 12B depict fan system 1200, according to an embodiment. Elements depicted in FIGS. 12A and 12B may be described above, and for the sake of brevity a further description of these elements may be omitted.

In FIGS. 12A and 12B, a pair of opposite blades 1230, 1232 may be driven by a driving axle 120. Specifically, a driving arm 1210 may have a first end coupled to a leading end of first blade 1230, and a second end coupled to a leading end of second blade 1232. This allows the forces between opposite blades to be substantially equally, allowing the opposite blades to work efficiently.

Responsive to driving axle 120 rotating, driving arm 1210 may correspondingly rotate, which may in turn rotate blades 1230, 1232 in opposite directions. In embodiments, the leading ends of blades 1230, 1232 may be configured to move along circumference 1206, while the trailing ends of blades 1230, 1232 may move outside of circumference 1204. This may allow for more flexibility in the attack angle of the blades in comparison to a system where the trailing ends of blades 1230, 1232 are confined to travel along circumference 1204.

A trailing axle 130 may be configured to provide rotation support of a trailing arm assembly 1220. Trailing axle 130 may be configured to allow the ends of trailing arm assembly 1220 to move along circumference 1202. In embodiments, a diameter of circumference 1202 may be less than a diameter of circumference 1206.

A first end of trailing arm assembly 1220 may be coupled with a proximal end of first trailing arm 1222, and a second end of trailing arm assembly 1222 may be coupled with a proximal end of second trailing arm 1224. A distal end of first trailing arm 1222 may be coupled with a trailing end of first blade 1230, and a distal end of second trailing arm 1224 may be coupled with a trailing end of second blade 1232. The trailing arms 1222, 1224 may be configured to move based on the movement of blades 1230, 1232, respectfully, which may be caused by the single driving arm 1210. In embodiments, the trailing arms 1222, 1224 may rotate independently, which may be at different speeds and angles at different points in time. Due to trailing arms 1222, 1224 rotating at different speeds along different paths their corresponding blades self-balance their attack angles, wherein the attack angles may change at different times from having an obtuse angle, zeroed angle, and acute angle.

Figure 13:
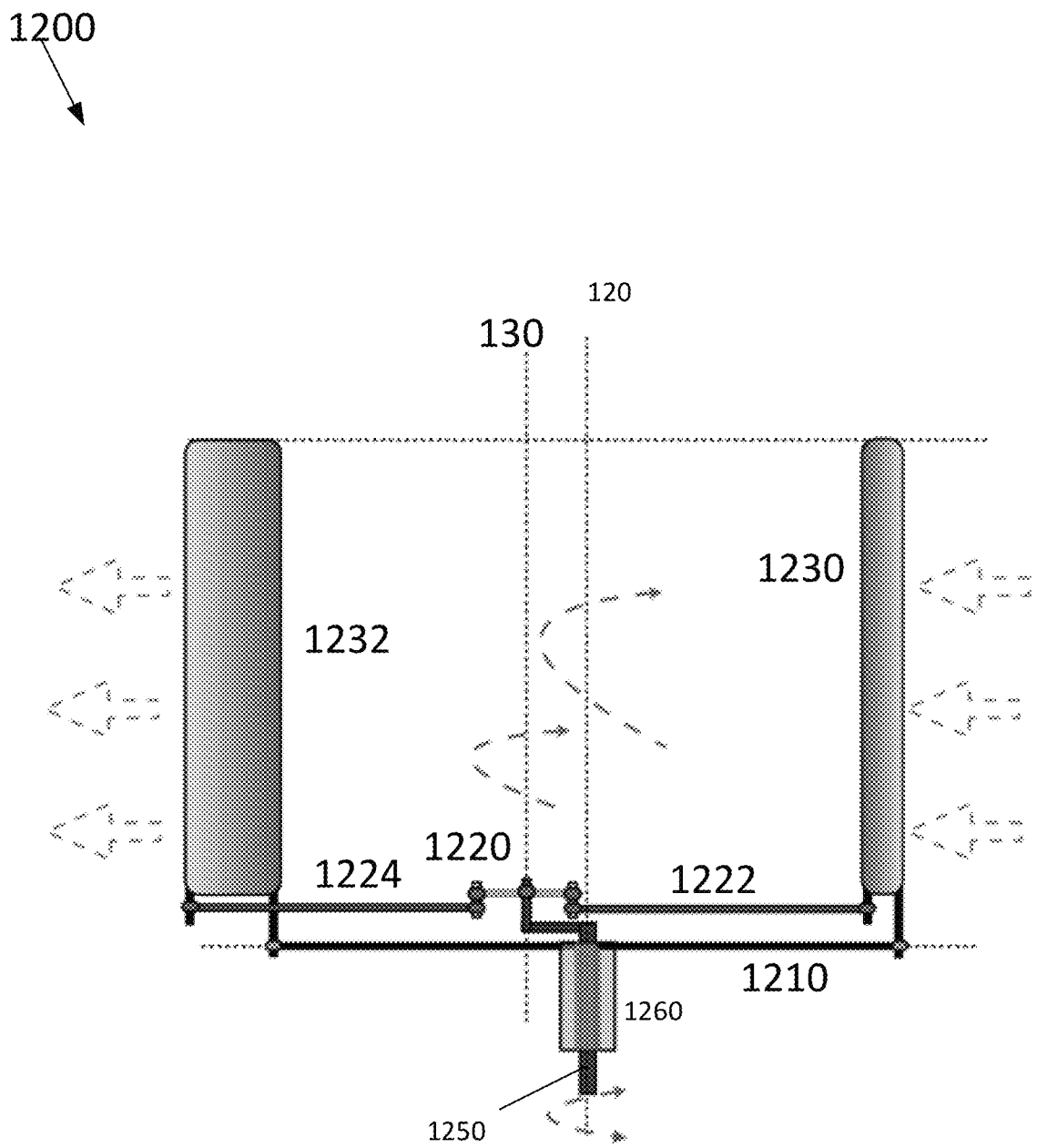
FIG. 13 depicts a top down view of a fan system, according to an embodiment.

FIG. 13 depicts a top down view of fan system 1200, according to an embodiment. Elements depicted in FIG. 13 may be described above, and for the sake of brevity a further description of these elements may be omitted.

In system 1200, a blade length of blades 1230, 1232 may be greater than a distance between driving axle 120 and trailing axle 130. The driving axle 120 is rotated by a hollow shaft 1260. Crank shaft assembly 1250 may extend through hollow shaft 1260, and transfers torque to trailing axle 130. When hollow shaft 1260 rotates, driving arm 1210 may correspondingly rotate to move the blades. Responsive to crank shaft assembly 1250 rotating, trailing axle will rotate about driving axle 120 to change a lateral and longitudinal offset between trailing axle 130 and driving axle 120.

Figure 14:
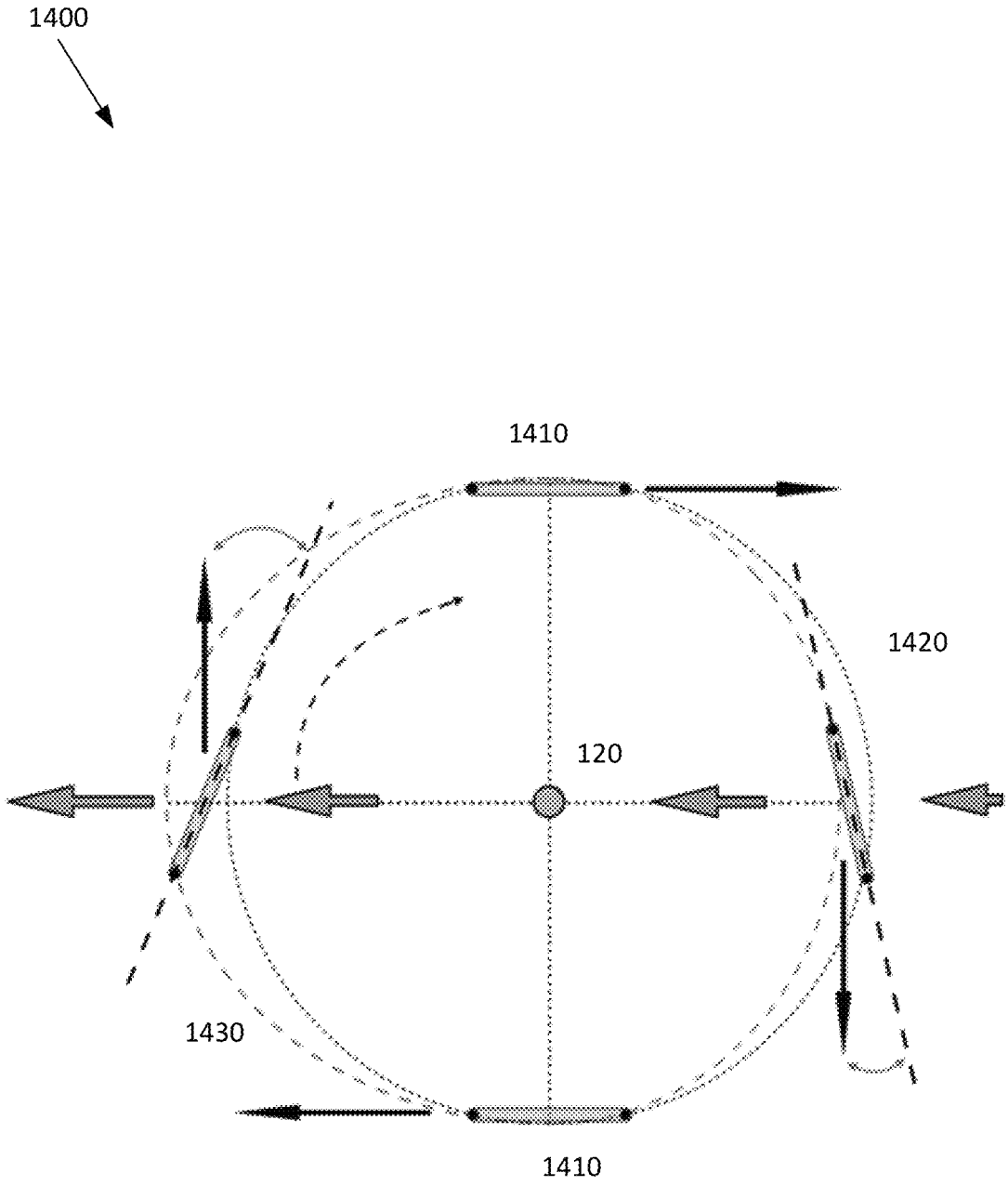
FIG. 14 depicts a fan system, according to an embodiment.

FIG. 14 depicts a fan system 1400, according to an embodiment. Elements depicted in FIG. 14 may be described above, and for the sake of brevity a further description of these elements may be omitted.

Fan system 1400 may include a plurality of blades 1410. Each of the blades 1410 may have a first end that is coupled to corresponding driving arm, and a second end that is coupled to a corresponding trailing arm. The first ends of the blades 1410 are configured to travel along a circular circumference 1420. The second ends of the blades 1410 are configured to travel along an asymmetrical circumference 1430. The asymmetry between the circular circumference 1420 and asymmetrical circumference 1430 may allow the attack angles of the blades 1410 on opposite sides to be different. This may increase the efficiency of the blades 1410 at desired intervals. Specifically, the attack angles of the blades at 90 degrees and 270 degrees may be equal. However, the attack angles of the blades at 0 degrees and 180 degrees may be different.

Figure 15A:
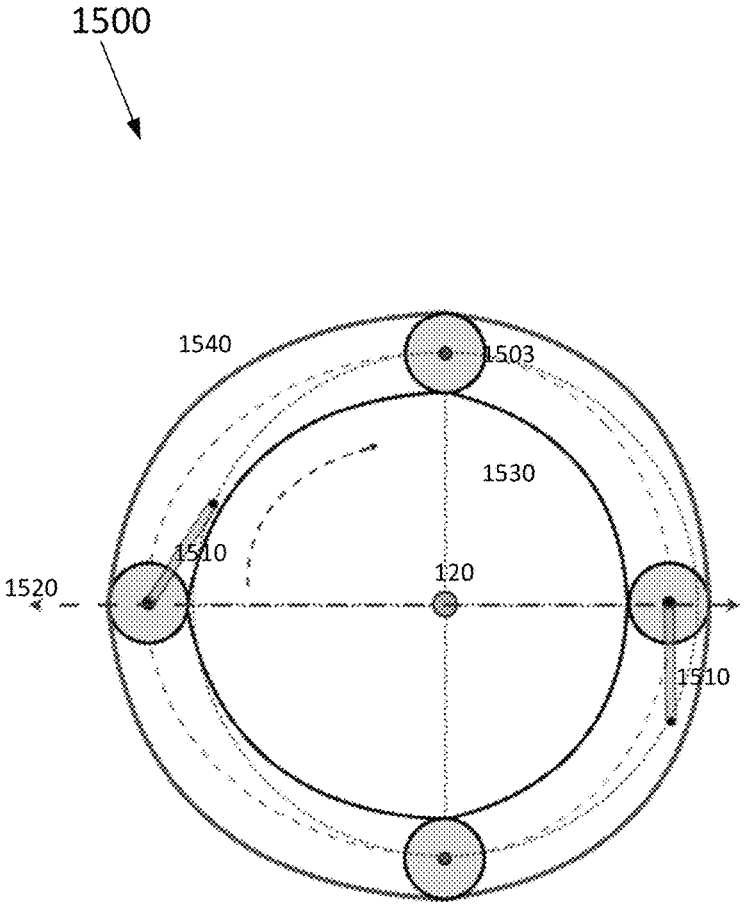
FIGS. 15A and 15B depict a fan system, according to an embodiment.
Figure 15B:
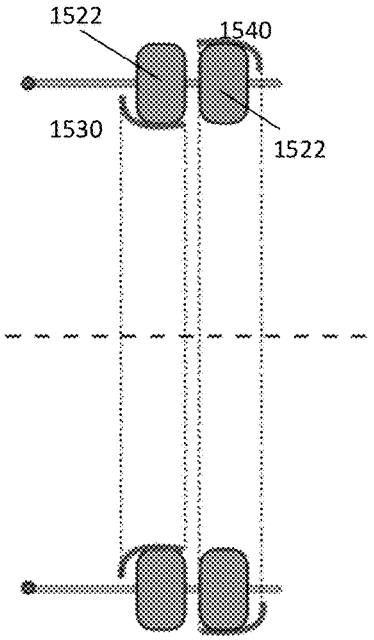

FIGS. 15A and 15B depict a fan system 1500, according to an embodiment. Elements depicted in FIGS. 15A and 15B may be described above, and for the sake of brevity a further description of these elements may be omitted.

As depicted in FIGS. 15A and 15B, fan system 1500 may include a plurality of blades 1510. Each of the blades 1510 may have a first end, a leading end, which is coupled with a corresponding driving arm (not shown) that rotates about the driving axle 120. The driving arm is configured to move the first end of the blade along a first circular circumference 1503. A second end of each of the blades 1510 may be coupled with a corresponding roller 1520. The rollers 1520 are configured to move along a circumference between an inner rail 1530 and an outer rail 1540, wherein the circumference between the rains may not be symmetrical. In embodiments, the inner rail 1530 and outer rail 1540 may be mechanically connected.

As depicted in FIG. 15B, each of the rollers 1520 may have two wheels 1522, 1524 that has a prolonged anchor that may be part of a corresponding blade 1510. In embodiments, as the driving arm moves the first end of the blades 1510, the rollers may be configured to trail the driving arm along rails 1530, 1540, while traveling along the asymmetrical circumference.

Figure 16A:
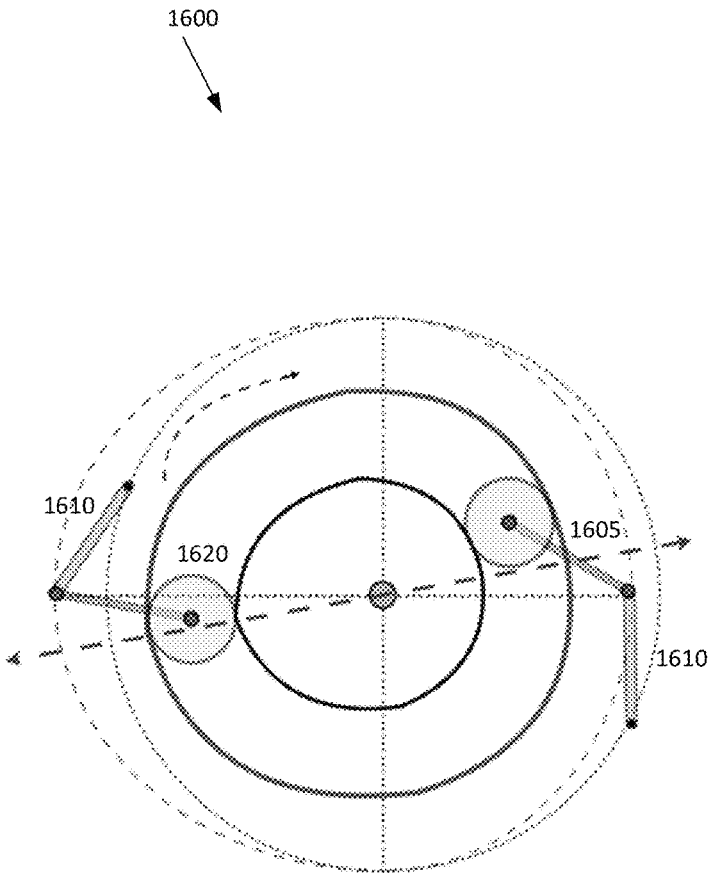
FIGS. 16A and 16B depict a fan system, according to an embodiment.
Figure 16B:
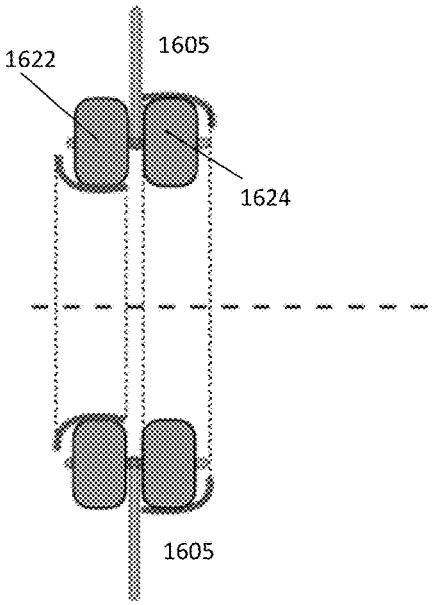

FIGS. 16A and 16B depict a fan system 1600, according to an embodiment. Elements depicted in FIGS. 16A and 16B may be described above, and for the sake of brevity a further description of these elements may be omitted.

System 1600 may have a plurality of blades 1610, wherein each blade 1610 may have a first end that is coupled to a distal end of a corresponding driving arm, which rotates about driving axle 1602. The first end of the blades may be configured to rotate about a first circular circumference.

A second end of each of the blades 1610 may be coupled to a distal end of a corresponding trailing arm, wherein the second end of each of the blades 1610 is configured to travel along an outer asymmetrical circumference. In embodiments, a proximal end of each of the trailing arms 1605 may be coupled with corresponding roller 1620, that traveling along an inner asymmetrical circumference.

As depicted in FIG. 16B, each of the rollers 1620 may have two wheels 1622, 1624, with the roller axle positioned through the wheels. The proximal end of the trailing arms may be coupled to a corresponding roller axle. In embodiments, as the driving arm moves the first end of the blades 1610, the trailing arms may be configured to apply a force against the rollers 1620 to move the rollers along the inner asymmetrical circumference. Due the mechanical boundaries of the inner asymmetrical circumference, the distal end of the trailing arms may move along the outer asymmetrical circumference.

The rollers 1620 are configured to move along a circumference between an inner rail 1630 and an outer rail 1640, wherein the circumference between the rains may not be symmetrical. In embodiments, the inner rail 1630 and outer rail 1640 may be mechanically connected.

Figure 17:
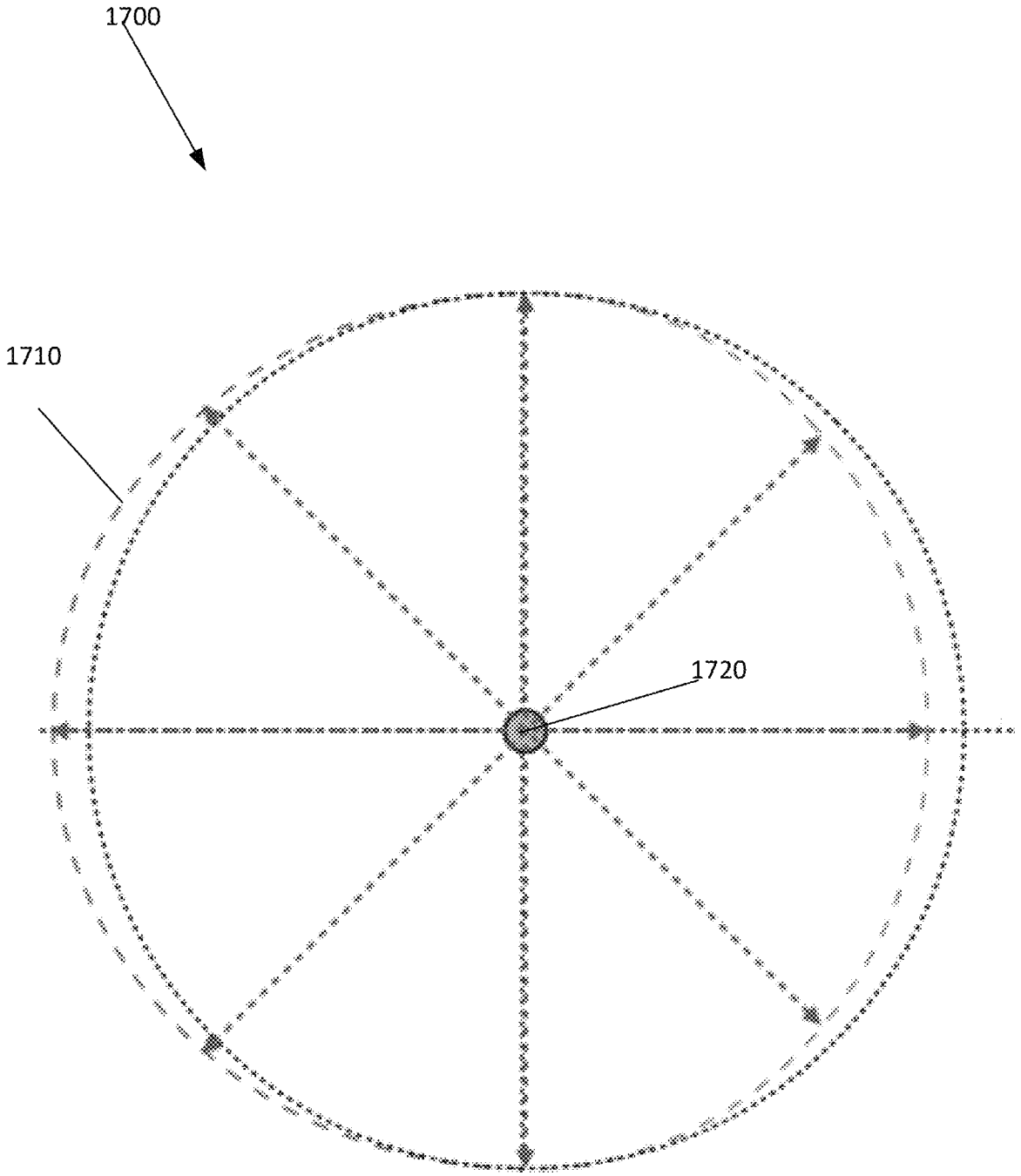
FIG. 17 depict a fan system, according to an embodiment.

FIG. 17 depict a fan system 1700, according to an embodiment. Elements depicted in FIG. 17 may be described above, and for the sake of brevity a further description of these elements may be omitted.

As depicted in FIG. 17, an egg-shaped disk wheel 1710 could be used in place of an inner wheel. Disk wheel 1710 may have a constant diameter with respect to its rotating axes 1720. Optimization of blade effectiveness can be obtained by making disk wheel 1710 have an oval shape, wherein a trailing arm is configured to move along the disk wheel 1710.

Figure 18A:
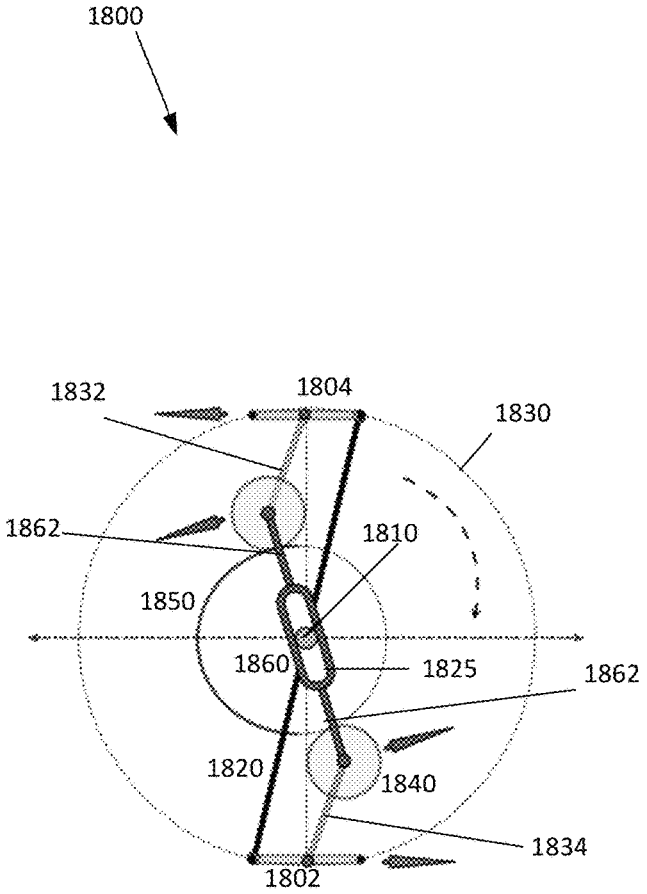
FIGS. 18A and 18B depict a fan system, according to an embodiment.
Figure 18B:
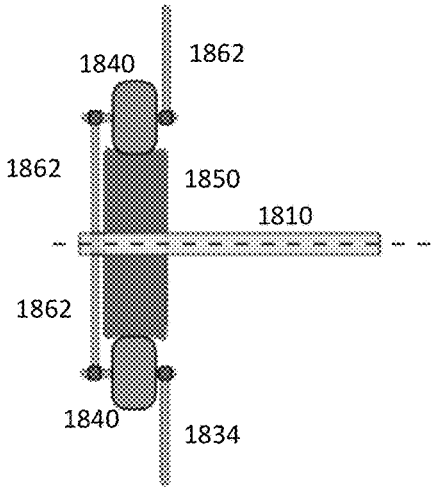

FIGS. 18A and 18B depict a fan system 1800, according to an embodiment. Elements depicted in FIGS. 18A and 18B may be described above, and for the sake of brevity a further description of these elements may be omitted.

System 1800 may include a driving axle 1810 that rotates a driving arm 1820, wherein a first end of the driving arm 1820 is coupled to a leading end of a first blade 1802, and a second end of the driving arm 1820 is coupled to a leading end of a second blade 1804. In embodiments, the first end and second end of driving arm 1820 may be positioned at any location along the blade in front of the distal end of a corresponding trailing arm 1832, 1834. The driving arm 1820 may be configured to rotate the leading end of the blades 1802, 1804 along a first circumference 1830.

The middle of the blades 1802, 1804 may be coupled to a distal end of a corresponding trailing arm 1832, 1834. However, in other embodiments, the corresponding trailing arm 1832, 1834 may be coupled anywhere along the length of the corresponding blade 1802, 1804, which is being the corresponding coupling point of driving arm 1820. The proximal ends of the trailing arms 1832, 1834 may be coupled to corresponding rollers 1840. The rollers 1840 may be configured to travel along an outer circumference of an egg shaped disk 1850.

A bracket 1860 may be utilized to couple the rollers via bracket arms 1862. The bracket 1860 may include an oval or oblong shaped slot 1825. Responsive to driving arm 1820 moving the leading ends of the blades 1802, 1804, slot 1820 may slide along the driving axle 1810. This may allow for blades 1802, 1804 to self-balance the attack angles of the blades, wherein the forces between the opposite blades are substantially equal.

FIG. 18B depicts how the driving axle 1810 may be extending through the slot 1825, and the rollers 1840 may be positioned on an egg shaped disk 1850 that is also positioned around driving axle 1810.

Figure 19A:
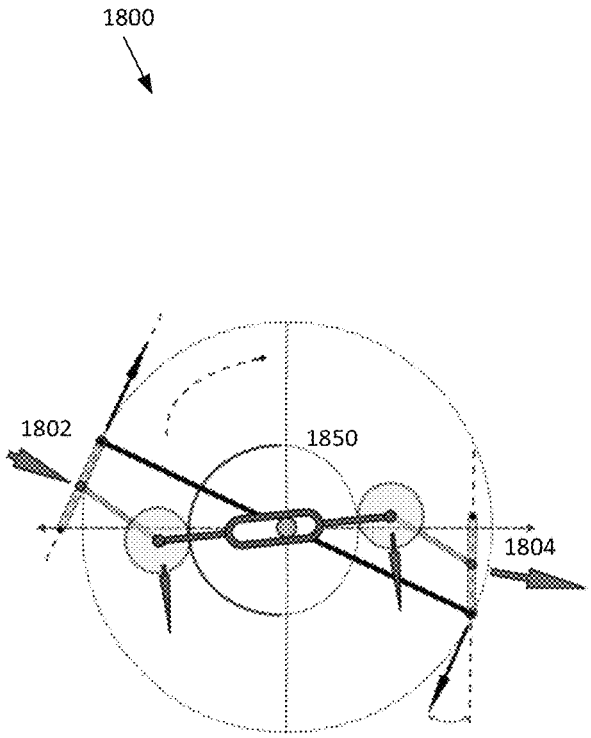
FIGS. 19A and 19B depict a fan system, according to an embodiment.
Figure 19B:
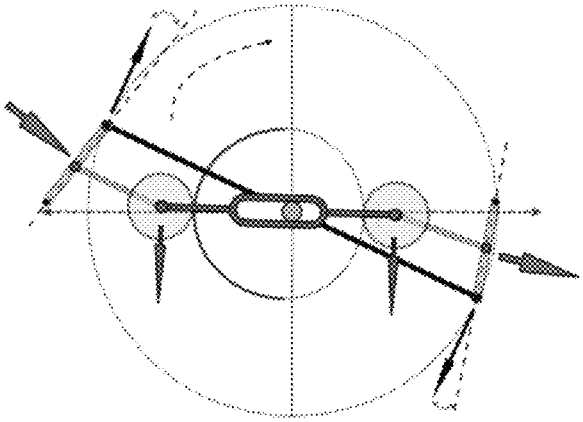

FIGS. 19A and 19B depict a fan system 1800, according to an embodiment. Elements depicted in FIGS. 19A and 19B may be described above, and for the sake of brevity a further description of these elements may be omitted.

As depicted in FIGS. 19A and 19B the egg shaped disk 1850 is configured to control the direction of the blades 1802, 1804. The two paired rollers may move under the resulting force of the blades 1802, 1802, wherein the attack angles of the blades 1802, 1804 move in opposite directions when the paired rollers move along the circumference of disk 1850.

Figure 20:
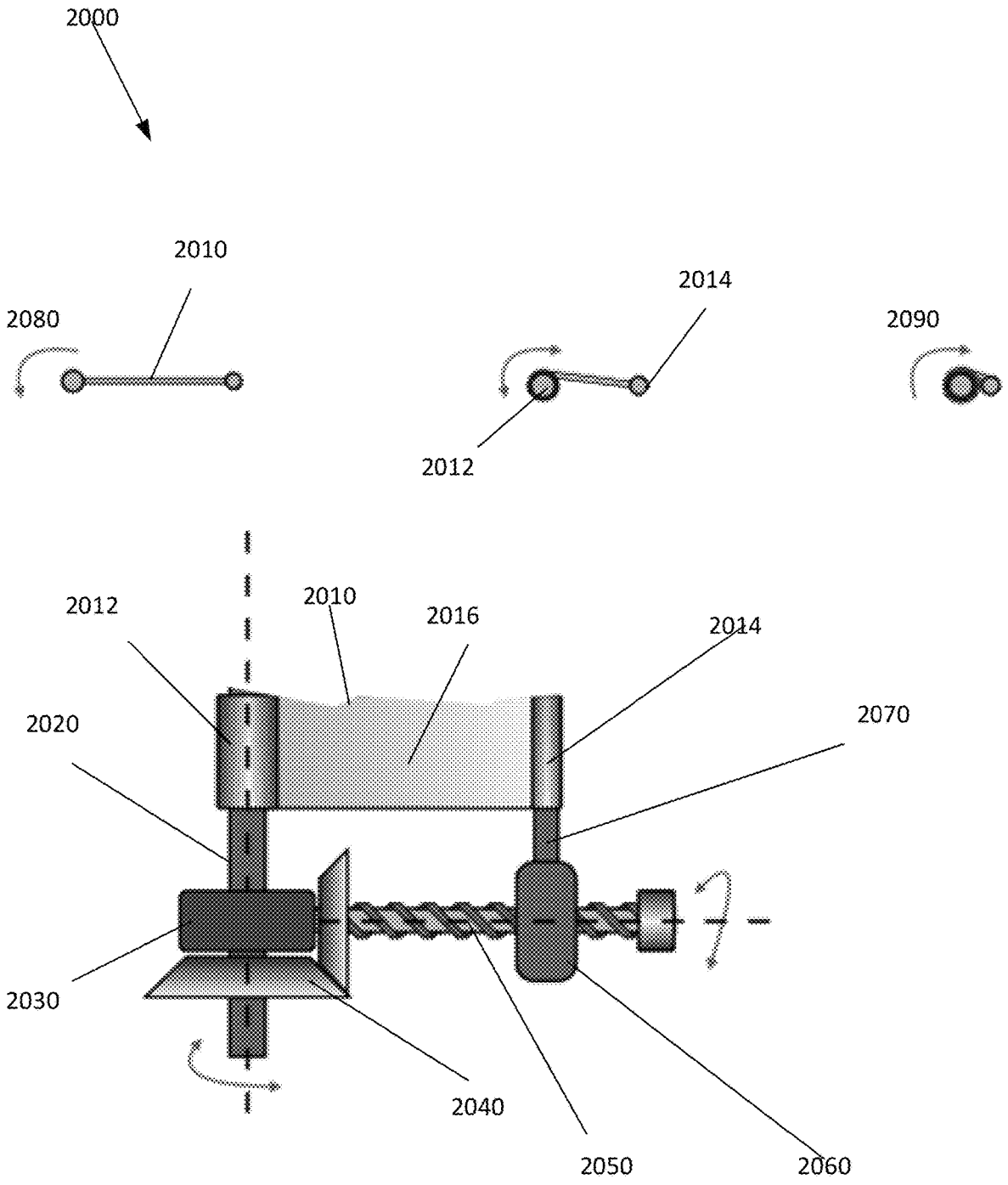
FIG. 20 depicts a system to modify sizes of blades, according to an embodiment.

FIG. 20 depicts a system 2000 to modify sizes of blades 2010, according to an embodiment. Elements depicted in FIG. 20 may be described above, and for the sake of brevity a further description is omitted.

System 2000 may include a variable length blade 2010. Blade 2010 may include a proximal end 2012, distal end 2014, and sail 2016.

The proximal end 2012 of blade 2010 may be positioned along an axle 2020, wherein proximal end 2012 may rotate around axle 2020 responsive to increasing or decreasing the distance between proximal end 2012 and distal end 2014. Based on the distance between proximal end 2012 and distal end 2014, more or less of sail 2016 may be exposed. When more of sail 2016 is exposed, blade 2010 may move and interact with more air.

Axle 2020 may also extend through a hub 2030 and Gear set 2040. The hub 2030 may be a freewheeling hub that is configured to provide support for axle 2020 against Gear set 2040.

Gear set 2040 may be a 90 degree angle gear set, and include a threaded shaft 2050 that extends along an axis perpendicular to axle 2020. In embodiments, the shaft 2050 may be configured to rotate to move nut 2060 along the axis perpendicular to axle 2020. Nut 2060 may be configured to move along a linear axis based on the rotation of shaft 2050. Nut 2060 may also include a shaft 2070 that extends in a direction in parallel to axle 2020. Shaft 2070 may be configured to receive distal end 2014 of the sail 2016. Responsive to rotating shaft 2070 in a first rotational direction 2080, nut 2060 may move in a first linear direction to decrease a distance between shaft 2070 and axle 2020. This may also cause sail 2016 to rotate around axle 2020 in a first direction, which may cause an exposed surface area of sail 2016 to decrease. Responsive to rotating shaft 2070 in a second rotational direction 2090, nut 2060 may move in a second linear direction to increase a distance between shaft 2070 and axle 2020. This may also cause sail 2016 to rotate around axle 2020 in a second direction, which may cause an exposed surface area of sail 2016 to increase. In other words, when nut 2060 moves in the first linear direction less of sail 2016 will become exposed, and when nut 2060 moves in the second linear direction more of sail 2016 will be exposed.

Figure 21:
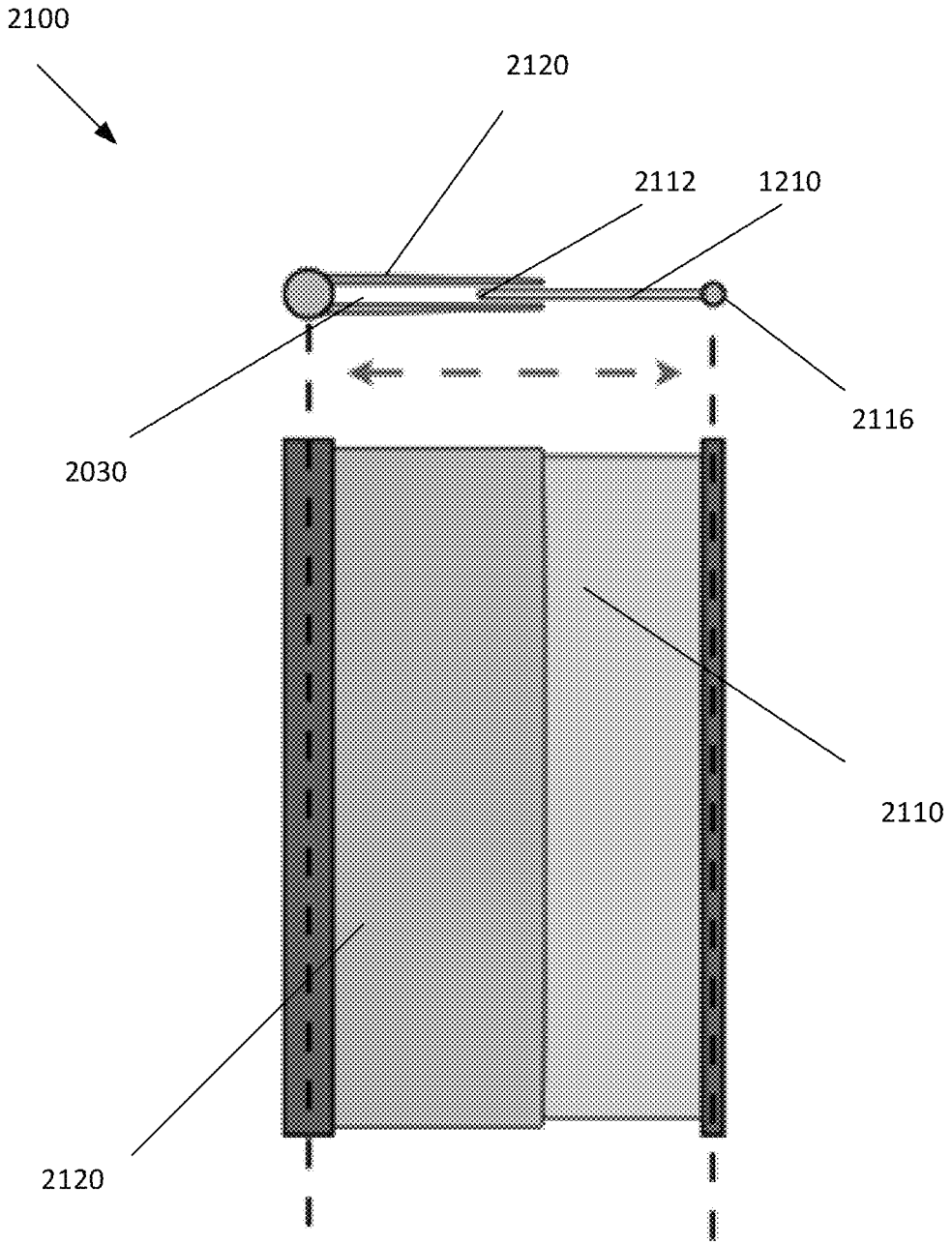
FIG. 21 depicts a system to modify sizes of blades, according to an embodiment.

FIG. 21 depicts a blade system 2100 to modify sizes of sails 2110, according to an embodiment. Elements depicted in FIG. 21 may be described above, and for the sake of brevity a further description is omitted.

System 2100 may include a blade housing 2120 and sails 2110.

Blade housing 2120 may include a pocket 2130 that is configured to receive a proximal end of sails 2110. A distal end of pocket 2130 may include a stopper that is configured to confine the movement of a proximal end of sails 2110 within the pocket 2130. Blade housing 2120 may have a fixed outer surface area.

Sails 2110 may include a proximal end 2112 and distal end 2116. Proximal end 2112 may be configured to move within the pocket 2130 to increase or decrease a total surface area of sails 2110. The distal end 2116 may include a bulbous portion, which may not allow distal end 2116 to travel within pocket 2130. Sails 2110 may have a dynamic, and changing, surface area based on how much of sails 2110 is positioned within pocket 2130.

To this end, blade system 2100 formed of housing 2120 and sails 2110 may allow blade system 2100 to be a telescopic blade 2110 that has a variable total surface area. In embodiments, the total surface area of the blade system 2110 may be modified based on a user performing actions to extend or retract the blade 2110. Then, blade 2110 may be locked in place. Alternatively, the total surface area of blade 2110 may dynamically change based on the forces applied to sails 2110 by a driving arm and the attack angle of sails 2110. This may create a fan system where different blades have different surface areas at the same time, wherein the surface area of each of the blades is constantly changing Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A fan system comprising:

a first blade and a second blade;

a driving arm having a first end coupled to the first blade and a second end coupled to the second blade, wherein the first end and the second end travel along a circular circumference;

a first roller coupled to the first blade;

a second roller coupled to the second blade, wherein the first roller and the second roller travel along an asymmetrical circumference.

2. The system of claim 1, wherein the first blade and the second blade are rotating at different speeds at a same point in time based on the asymmetrical circumference.

3. The fan system of claim 1, further comprising:

a first trailing arm coupled to the first roller and the first blade;

a second trailing arm coupled to the second roller and the second blade, wherein a first angle between the first trailing arm and the first blade is different from a second angle between the second trailing arm and the second blade at a same point in time.

4. The system of claim 3, wherein asymmetrical circumference is positioned within the first circumference.

5. The system of claim 3, further comprising:

a bracket with a first bracket arm coupled to the first roller, and a second bracket arm coupled to the second roller.

6. The system of claim 5, further comprising:

a driving axle configured to rotate the driving arm, wherein the bracket includes a slot that is configured to encompass the driving axle.

7. The system of claim 6, wherein the driving axle is positioned through the slot, and the slot is oval or oblong in shape with a longer length than width.

8. The system of claim 7, wherein a total length of the first bracket arm and the first trailing arm is longer than half of a length of the driving arm.

9. The system of claim 3, wherein the first trailing arm is coupled to the first blade at a first location and the driving arm is coupled to the first blade at a second location, the first location being positioned behind the second location.

10. The system of claim 9, wherein the first blade rotates in a direction from the first location towards the second location.

11. A method for a fan comprising:

coupling a first end of a driving arm to a first blade;

coupling a first roller to the first blade;

coupling a second end of the driving arm to the second blade, wherein the first end and the second end travel along a circular circumference;

coupling a second roller to the second blade;

moving the first roller and the second roller along an asymmetrical circumference.

12. The method of claim 11, further comprising:

rotating the first blade and the second blade at different speeds at a same point in time based on the asymmetrical circumference.

13. The method of claim 11, further comprising:

coupling a first trailing arm to the first roller and the first blade;

coupling a second trailing arm to the second roller and the second blade, wherein a first angle between the first trailing arm and the first blade is different from a second angle between the second trailing arm and the second blade at a same point in time.

14. The method of claim 13, wherein asymmetrical circumference is positioned within the first circumference.

15. The method of claim 13, further comprising:

coupling a bracket with a first bracket arm to the first roller, and coupling a second bracket arm of the bracket to the second roller.

16. The method of claim 15, further comprising:

rotating the driving arm, wherein the bracket includes a slot that is configured to encompass a driving axle.

17. The method of claim 16, further comprising:

positioning the driving axle through the slot, and the slot is oval or oblong in shape with a longer length than width.

18. The method of claim 17, wherein a total length of the first bracket arm and the first trailing arm is longer than half of a length of the driving arm.

19. The method of claim 13, wherein the first trailing arm is coupled to the first blade at a first location and the driving arm is coupled to the first blade at a second location, the first location being positioned behind the second location.

20. The method of claim 19, wherein the first blade rotates in a direction from the first location towards the second location.

* * * * *